US009499368B2

(12) United States Patent
Imamura et al.

(10) Patent No.: US 9,499,368 B2
(45) Date of Patent: Nov. 22, 2016

(54) IMAGE RECORDING DEVICE AND IMAGE RECORDING METHOD

(71) Applicant: SEIKO EPSON CORPORATION, Tokyo (JP)

(72) Inventors: Atsushi Imamura, Nagano (JP); Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/883,728

(22) Filed: Oct. 15, 2015

(65) Prior Publication Data

US 2016/0114601 A1 Apr. 28, 2016

(30) Foreign Application Priority Data

Oct. 23, 2014 (JP) ..... 2014-215997

(51) Int. Cl.

| | |
|---|---|
| ***B41J 11/00*** | (2006.01) |
| ***B65H 20/02*** | (2006.01) |
| ***B41J 15/16*** | (2006.01) |
| ***B65H 23/188*** | (2006.01) |

(52) U.S. Cl.

CPC ..... *B65H 20/02* (2013.01); *B41J 15/16* (2013.01); *B65H 23/1888* (2013.01); *B65H 2511/512* (2013.01); *B65H 2513/11* (2013.01); *B65H 2515/32* (2013.01); *B65H 2553/41* (2013.01); *B65H 2801/15* (2013.01)

(58) Field of Classification Search

CPC ..... B41J 11/002; B41J 15/16; B41J 15/165; B41J 15/042; B41J 11/007; B41J 13/08; B41M 7/00; B65H 23/192; B65H 23/198; B65H 23/1955

See application file for complete search history.

(56) References Cited

U.S. PATENT DOCUMENTS

| | | | | |
|---|---|---|---|---|
| 6,644,802 | B2 * | 11/2003 | Minowa | B41J 11/002 347/100 |
| 7,934,824 | B2 * | 5/2011 | Nishida | B41J 11/002 347/102 |
| 8,746,834 | B2 * | 6/2014 | Toya | B41J 11/002 347/104 |
| 8,807,689 | B2 * | 8/2014 | Hori | B41J 15/16 347/16 |
| 9,096,081 | B2 * | 8/2015 | Katagami | B41J 11/0015 |
| 2012/0242735 | A1 | 9/2012 | Izawa et al. | |
| 2013/0135378 | A1 | 5/2013 | Tanjo et al. | |

FOREIGN PATENT DOCUMENTS

| | | | |
|---|---|---|---|
| JP | 09-267500 | A | 10/1997 |
| JP | 2012-024932 | A | 2/2012 |
| JP | 2012-200976 | A | 10/2012 |
| JP | 2013-116786 | A | 6/2013 |

* cited by examiner

*Primary Examiner* — Anh T. N. Vo

(74) *Attorney, Agent, or Firm* — Global IP Counselors, LLP

(57) ABSTRACT

An image recording device includes a drive roller, a driven roller, a recording unit and a control unit. The driven roller is configured and arranged with respect to the drive roller so that the recording medium is grasped between the drive roller and the driven roller. The recording unit is configured and arranged to record an image on the recording medium arranged further to a downstream side than the drive roller in a first direction. When the control unit stops conveying of the recording medium in the first direction, the control unit is configured to stop conveying of the recording medium in a state in which an area of the recording medium different from an area, in which the image is planned to be recorded after a timing at which conveying of the recording medium is stopped, is in contact with the driven roller.

10 Claims, 7 Drawing Sheets

| BASE MATERIAL | NIP LOAD | NIP TIME | | | | | | |
|---|---|---|---|---|---|---|---|---|
| | | 1 sec. | 2.5 sec. | 4.6 sec. | 5 sec. | 6.8 sec. | 10 sec. | 61.4 sec. |
| #76911 | 200N | ○ | | | △ | | △ | × |
| | 100N | ◎ | ◎ | ○ | ○ | ○ | ○ | △ |
| | 70N | ◎ | | | ○ | | | △ |

◎: INVISIBLE
○: ALMOST INVISIBLE
△: SLIGHTLY VISIBLE
× : VISIBLE

IMAGE RECORDING DEVICE AND IMAGE RECORDING METHOD

CROSS-REFERENCE TO RELATED APPLICATIONS

This application claims priority to Japanese Patent Application No. 2014-215997 filed on Oct. 23, 2014. The entire disclosure of Japanese Patent Application No. 2014-215997 is hereby incorporated herein by reference.

BACKGROUND

1. Technical Field

The present invention relates to an image recording device and an image recording method for conveying media while grasping the recording media with a drive roller and a driven roller.

2. Related Art

The printer of Japanese Unexamined Patent Publication No. 2013-116786 records an image on a web using a recording head arranged to the downstream side in the conveyance direction in relation to the drive roller while conveying the web in the conveyance direction by rotating a drive roller. In particular, this printer is equipped with a nip roller that grasps the web between it and the drive roller, and conveys the web while ensuring friction force between the drive roller and the web.

SUMMARY

However, with the kind of printer noted above, conveying of the recording medium is stopped as appropriate. At this time, by unrecorded recording medium being stopped for a long time between the drive roller and the nip roller, the unrecorded recording medium that was positioned between the drive roller and the nip roller degenerates. As a result, it is not possible to do a good recording of the image on the degenerated part with the image recording operation after that, and there were cases when the image quality of the image including the degenerated part decreased.

The present invention was created considering the problem noted above, and an object is to provide an image recording device and an image recording method capable of inhibiting a decrease in the image quality with an image recording device and image recording method that convey recording medium while grasping it between a drive roller and a driven roller.

An image recording device according to one aspect includes a drive roller, a driven roller, a recording unit and a control unit. The drive roller is configured and arranged to convey recording medium by rotating. The driven roller is configured and arranged with respect to the drive roller so that the recording medium is grasped between the drive roller and the driven roller. The recording unit is configured and arranged to record an image on the recording medium arranged further to a downstream side than the drive roller in a first direction which is the recording medium conveyance direction. The control unit is configured to control the recording unit and the drive roller to record the image on the recording medium while conveying the recording medium in the first direction. When the control unit stops conveying of the recording medium in the first direction, the control unit is configured to stop conveying of the recording medium in a state in which an area of the recording medium different from an area, in which the image is planned to be recorded after a timing at which conveying of the recording medium is stopped, is in contact with the driven roller.

An image recording method according to another aspect includes: recording an image on a recording medium by a recording unit arranged further to a downstream side in a first direction, which is a conveyance direction of the recording medium, than a drive roller while rotating the drive roller to convey the recording medium grasped between the drive roller and a driven roller; and stopping conveying of the recording medium in a state in which an area of the recording medium different from an area, in which the image is planned to be recorded after a timing at which conveying of the recording medium is stopped, is in contact with the driven roller.

With the above mentioned aspects (image recording device and image recording method) constituted in this way, an image is recorded on the recording medium by a recording unit while conveying the recording medium by grasping the recording beta between the drive roller and the driven roller and rotating the drive roller. With this constitution, when conveying of the recording medium stops, of the recording medium, the part that stopped between the drive roller and the driven roller while remaining grasped thereby sometimes becomes degenerated. Therefore, with the image recording operation after that, there were cases when the image quality decreased for the image formed overlapping the degenerated part.

In contrast to this, with the above mentioned aspects, conveying of the recording medium is stopped in a state for which of the recording medium, an area different from the area for which recording of an image is planned after the point at which conveying of the recording medium is stopped is in contact with the driven roller. Therefore, even if, of the recording medium, the part grasped between the drive roller and the driven roller is degenerated during the stopping of conveying, there is no recording of an image on that degenerated part with the image recording operation thereafter. As a result, it is possible to inhibit the kind of decrease in image quality noted above.

When the control unit stops conveying of the recording medium in the first direction, the control unit is preferably configured to stop conveying of the recording medium in a state in which, an area of the recording medium between an area, in which the recording unit has already recorded the image, and the area, in which the image is planned to be recorded after the timing at which conveying of the recording medium is stopped, is in contact with the driven roller. Alternatively, the image recording device can also be constituted such that the recording unit is configured and arranged to record the image on the recording medium having an already printed print image, and when the control unit stops conveying of the recording medium in the first direction, the control unit is configured to stop conveying of the recording medium in a state in which, an area of the recording medium, which is an area in which the print image is printed and which is different from the area in which an image is planned to be recorded after the timing at which conveying of the recording medium is stopped, is in contact with the driven roller.

Furthermore, the image recording device can be constituted such that when the control unit stops conveying of the recording medium in the first direction, the control unit is configured to convey a prescribed amount of the recording medium in a second direction reverse to the first direction after stopping conveying of the recording medium in the first direction and to stop conveying of the recording medium in a state in which an area of the recording medium different from the area, in which the image is planned to be recorded after the timing at which conveying of the recording medium is stopped, is in contact with the driven roller.

At this time, it is also possible to constitute the image recording device so that the control unit is configured to control the drive roller to start conveying the recording medium in the second direction within 2.5 seconds after conveying of the recording medium in the first direction stops. With this constitution, it is possible to suppress the time for which the recording medium is temporarily stopped between the drive roller and the driven roller in accordance with switching of the recording medium conveyance direction to within 2.5 seconds. As a result, it is possible to inhibit degradation of the part of the recording medium that is temporarily stopped between these rollers.

It is also possible to constitute the image recording device such that the control unit is configured to stop conveying of the recording medium in the first direction when an area of the recording medium different from the area, in which the image is planned to be recorded from after the timing at which conveying of the recording is stopped, reaches the driven roller as the recording medium is conveyed in the first direction.

It is also possible for the image recording device to be constituted so as to be equipped with an exterior member housing the drive roller, the driven roller, and the recording unit; a door provided on the exterior member; a locking mechanism configured and arranged to lock the door; and a user interface configured and arranged to receive instructions from a user and to transmit the instructions to the control unit, wherein the control unit is configured to control the drive roller to stop conveying of the recording medium in the first direction in accordance with a stop instruction from the user, to control the locking mechanism to lock the door until conveying of the recording medium in the second direction stops, and to unlock the door after conveying of the recording medium in the second direction has stopped. With this constitution, it is possible to prevent access by a user to the interior of the exterior member by locking the door until conveying of the recording medium in the second direction stops, and after conveying of the recording medium in the second direction stops, it is possible for the user to realize a desired task on the interior of the exterior member by having the door unlocked.

It is also possible for the image recording device to be constituted such that the driven roller has rubber on an outer circumference surface, and a surface of the recording medium on which the image is recorded is contacted by the outer circumference surface. With this constitution, it is easy for the decrease in image quality described above to occur on the recording medium. In light of that, it is preferable to inhibit the decrease in image quality by applying the present invention.

It is also possible for the image recording device to be constituted such that the driven roller has a tetrafluoro ethylene perfluoro alkyl vinyl ether copolymer on an outer circumference surface, and a surface of the recording medium on which the image is recorded is contacted by the outer circumference surface. With this constitution as well, there are cases when the decrease in image quality described above occurs. In light of that, it is preferable to inhibit the decrease in image quality by applying the present invention.

BRIEF DESCRIPTION OF THE DRAWINGS

Referring now to the attached drawings which form a part of this original disclosure:

FIG. 2 is a perspective view schematically showing the exterior member the printer is equipped with.

DETAILED DESCRIPTION OF EXEMPLARY EMBODIMENTS

Figure 1:
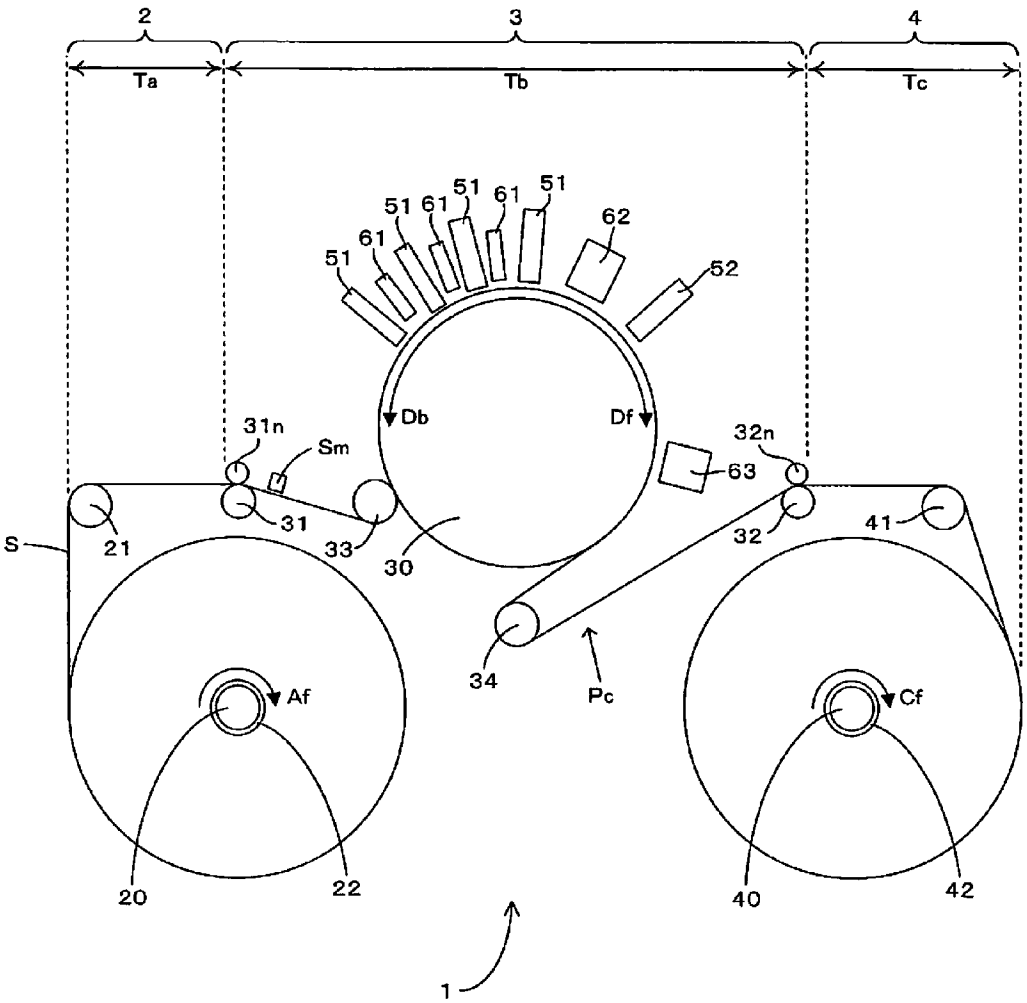
FIG. 1 is a front view schematically showing the device configuration with which a printer that can execute the present invention is equipped.

FIG. 1 is a front view schematically showing an example of the device constitution a printer capable of executing the present invention is equipped with. As shown in FIG. 1, with the printer 1, a long web S (web) for which both ends are wound in roll form on a delivery shaft 20 and a winding shaft 40 is stretched along a conveyance path Pc, and the web S undergoes image recording while being conveyed in a conveyance direction Df facing from the delivery shaft 20 to the winding shaft 40. The web S material types are roughly divided into paper and film. To list specific examples, for paper, there is high quality paper, cast paper, art paper, coated paper and the like, and for film, there is synthetic paper, PET (polyethylene terephthalate), PP (polypropylene) and the like. Schematically, the printer 1 is equipped with a delivery part 2 (delivery area) that delivers the web S from the delivery shaft 20, a processing part 3 (processing area) that records an image on the web S delivered from the delivery part 2, and a winding part 4 (winding area) that winds the web S on which the image is recorded by the processing part 3 by the winding shaft 40. With the description hereafter, of the two surfaces of the web S, the surface on which the image is recorded is called the front surface, and the reverse side surface to that is called the back surface.

The delivery part 2 has the delivery shaft 20 on which the end of the web S is wound, and a driven roller 21 that winds the web S pulled from the delivery shaft 20. In a state with the front surface of the web S facing the outside, the delivery shaft 20 winds and supports the end of the web S. Also, by rotating the delivery shaft 20 in the rotation direction Af (clockwise in FIG. 1), the web S wound on the delivery shaft 20 is delivered via the driven roller 21 to the processing part 3. Incidentally, the web S is wound on the delivery shaft 20 via a core tube 22 that can be attached and detached with the delivery shaft 20. Therefore, when the web S of the delivery shaft 20 is used up, a new core tube 22 on which the web S is wound in roll form is mounted on the delivery shaft 20, making it possible to replace the web S of the delivery shaft 20.

The processing part 3 performs processing as appropriate using each functional unit 51, 52, 61, 62, and 63 arranged along the outer circumference surface of a rotating drum 30 while supporting the web S delivered from the delivery part 2 on the rotating drum 30, and records an image on the web S. With this processing part 3, a forward drive roller 31 and a rear drive roller 32 are provided at both sides of the rotating drum 30, the web S conveyed facing the conveyance direction Df from the forward drive roller 31 to the rear drive roller 32 is supported on the rotating drum 30, and it undergoes image recording.

The forward drive roller 31 has a plurality of minute projections formed by thermal spraying on the outer circumference surface, and the web S delivered from the delivery part 2 is wound from the back surface side. Also, by the forward drive roller 31 rotating clockwise in FIG. 1, the web S delivered from the delivery part 2 is conveyed to the downstream side of the conveyance direction Df. A nip roller 31*n* (driven roller) having an outer circumference surface formed using an elastic member, and having greater elasticity than the forward drive roller 31, faces opposite the forward drive roller 31. Here, as the elastic member, examples include rubber or PFA (tetrafluoro ethylene perfluoro alkyl vinyl ether copolymer or the like). This nip roller 31*n* is energized to the forward drive roller 31 side, and follows the conveyance of the web S to rotate while abutting the front surface of the web S with its outer circumference surface. In this way, by grasping the web S between the forward drive roller 31 and the nip roller 31*n*, frictional force is ensured between the forward drive roller 31 and the web S, and it is possible to reliably perform conveying of the web S by the forward drive roller 31.

The rotating drum 30 is supported so as to be able to rotate in both directions of the conveyance direction Df and the reverse direction to that Db using a support mechanism (not illustrated), and for example is a cylindrical shaped drum having a diameter of 400 mm, and the web S conveyed from the forward drive roller 31 to the rear drive roller 32 is wound from the back surface side. This rotating drum 30 is an item that receives friction force with the web S, and supports the web S from the back surface side while doing following (driven) rotation with the web S. Incidentally, with the processing part 3, driven rollers 33 and 34 that fold back the web S are provided at both sides of the winding part onto the rotating drum 30. Of these, the driven roller 33 winds the front surface of the web S between the forward drive roller 31 and the rotating drum 30, and folds back the web S. Meanwhile, the driven roller 34 winds the front surface of the web S between the rotating drum 30 and the rear drive roller 32, and folds back the web S. In this way, by folding back the web S respectively at the upstream and downstream side of the conveyance direction Df in relation to the rotating drum 30, it is possible to ensure a long winding part of the web S onto the rotating drum 30.

The rear drive roller 32 has a plurality of minute projections formed using thermal spraying on the outer circumference surface, and the web S conveyed via the drive roller 34 from the rotating drum 30 is wound from the back surface side. Also, by the rear drive roller 32 rotating clockwise in FIG. 1, the web S is conveyed to the winding part 4 of the downstream side of the conveyance direction Df. A nip roller 32*n* (driven roller) having an outer circumference surface formed using an elastic member, and having greater elasticity than the rear drive roller 32, faces opposite the rear drive roller 32. Here, as the elastic member, examples include rubber, PFA or the like. This nip roller 32*n* is energized to the rear drive roller 32 side, and rotates following the conveying of the web S while abutting the front surface of the web S with its outer circumference surface. By the web S being grasped between the rear drive roller 32 and the nip roller 32*n* in this way, friction force between the rear drive roller 32 and the web S is ensured, and it is possible to reliably perform conveyance of the web S by the rear drive roller 32.

In this way, the web S conveyed from the forward drive roller 31 to the rear drive roller 32 is supported on the outer circumference surface of the rotating drum 30. Also, with the processing part 3, a plurality of recording heads 51 corresponding to mutually different colors are provided for recording a color image on the front surface of the web S supported on the rotating drum 30. In specific terms, four recording heads 51 corresponding to yellow, cyan, magenta, and black are aligned in the conveyance direction Df in this color sequence. Each recording head 51 faces the surface of the web S rolled onto the rotating drum 30 with a slight clearance left open, and ink of the corresponding color (colored ink) is discharged from the nozzle using the inkjet method. Then, by ink being discharged by each recording head 51 on the web S conveyed in the conveyance direction Df, a color image is formed on the surface of the web S.

Incidentally, as the ink, UV (ultraviolet) ink that is cured by the irradiation of ultraviolet rays (light) (photocurable ink) is used. In light of that, with the processing part 3, to cure the ink and fix it to the web S, UV irradiators 61 and 62 (irradiation units) are provided. This ink curing is executed divided into two stages of preliminary curing and main curing. The UV irradiators 61 for preliminary curing are arranged between each of the plurality of recording heads 51. In other words, the UV irradiators 61, by irradiating ultraviolet light of weak irradiation strength, cure the ink to a level for which the ink wetting and spreading is sufficiently slow (preliminary curing) compared to when ultraviolet light is not irradiated, and do not do main curing of the ink. On the other hand, the UV irradiator 62 for doing main curing is provided at the downstream side of the conveyance direction Df in relation to the plurality of recording heads 51. In other words, the UV irradiator 62 performs curing to the level at which the ink wetting and spreading is stopped (main curing) by irradiating ultraviolet light of a stronger irradiation strength than the UV irradiators 61.

In this way, the UV irradiators 61 arranged between each of the plurality of recording heads 51 do preliminary curing of the colored ink discharged on the web S from the recording heads 51 on the upstream side of the conveyance direction Df. Therefore, the ink discharged on the web S by one recording head 51 undergoes preliminary curing by the time it reaches the adjacent recording head 51 to the one recording head 51 at the downstream side of the conveyance direction Df. By doing this, the occurrence of mixed colors by which colored inks of different colors are mixed together is suppressed. In this kind of state with mixed colors suppressed, the plurality of recording heads 51 discharge colored inks having mutually different colors, and form a color image on the web S. Also, the UV irradiator 62 for main curing is provided further to the downstream side in the conveyance direction Df than the plurality of recording heads 51. Because of that, the color image formed using the plurality of recording heads 51 undergoes main curing by the UV irradiator 62 and is fixed on the web S.

Furthermore, the recording head 52 is provided at the downstream side of the conveyance direction Df in relation to the UV irradiator 62. This recording head 52 faces opposite the surface of the web S rolled onto the rotating drum 30 with a slight clearance left open, and discharges transparent UV ink onto the surface of the web S from nozzles using the inkjet method. In other words, transparent ink is further discharged onto the color image formed using the four colors of recording heads 51. This transparent ink is discharged on the entire surface of the color image, and gives the color image a feeling of glossiness or matte finish.

Also, a UV irradiator 63 (irradiation unit) is provided to the downstream side of the conveyance direction Df in relation to the recording head 52. By this UV irradiator 63 irradiating strong ultraviolet light, it performs main curing of the transparent ink discharged by the recording head 52. By doing this, it is possible to fix the transparent ink to the web S front surface.

In this way, with the processing part 3, ink discharge and curing are suitably executed on the web S wound onto the outer circumference part of the rotating drum 30, and a color image coated with transparent ink is formed. Then, the web S on which this color image is formed is conveyed to the winding part 4 by the rear drive roller 32.

In addition to the winding shaft 40 on which the end of the web S is wound, this winding part 4 has a driven roller 41 on which the web S is wound from the back surface side between the winding shaft 40 and the rear drive roller 32. In a state with the front surface of the web S facing the outside, the winding shaft 40 winds up and supports the end of the web S. In other words, when the winding shaft 40 rotates in rotation direction Cf (clockwise in FIG. 1), the web S conveyed from the rear drive roller 32 is wound onto the winding shaft 40 via the driven roller 41. Incidentally, the web S is wound onto the winding shaft 40 via a core tube 42 that can be attached and detached with the winding shaft 40. Therefore, it is possible to remove the web S for each core tube 42 when the web S wound onto the winding shaft 40 becomes full.

Also, the printer 1 is equipped with a mark sensor Sm facing opposite the surface of the web S between the nip roller 31*n* and the driven roller 33. In other words, of the surface of the web S, at the outside of the image recording area, a plurality of alignment marks are aligned at an even pitch in a conveyance direction Df, and the mark sensor Sm detects the alignment marks that pass through that detection area. Also, as will be described later, the conveying of the web S is controlled based on the detection results of the mark sensor Sm.

Figure 2:
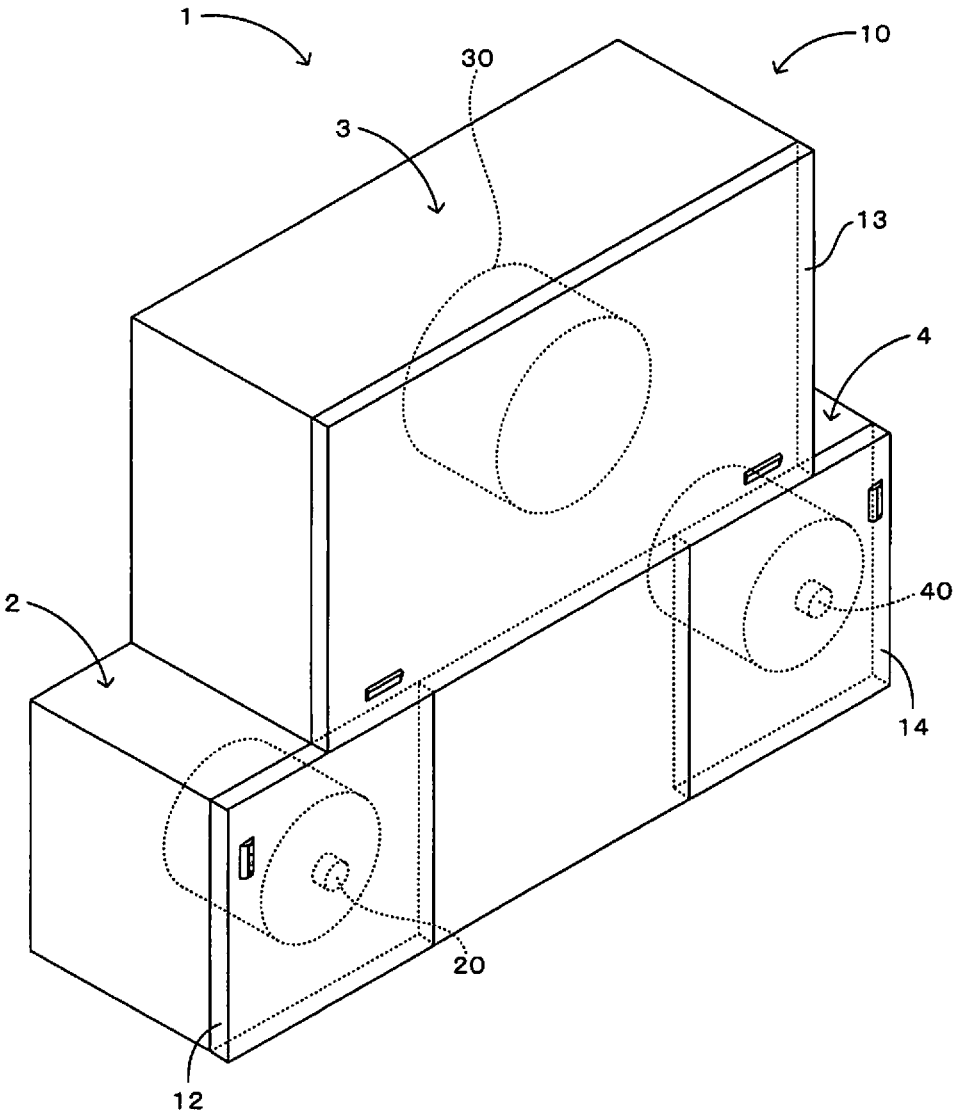

Furthermore, the printer 1 is equipped with an exterior member 10, and the constitution noted above shown in FIG. 1 is housed inside the exterior member 10 (FIG. 2). Here, FIG. 2 is a perspective view schematically showing the exterior member that the printer is equipped with, and in that drawing, the parts of the constitution housed in the exterior member 10 (delivery shaft 20, rotating drum 30, and winding shaft 40) are shown with a dotted line. The exterior member 10 is equipped respectively with doors 12, 13, and 14 facing opposite the delivery part 2, the processing part 3, and the winding part 4. Therefore, the user is able to access the delivery part 2, the processing part 3, and the winding part 4 by opening the doors 12, 13, and 14.

Figure 3:
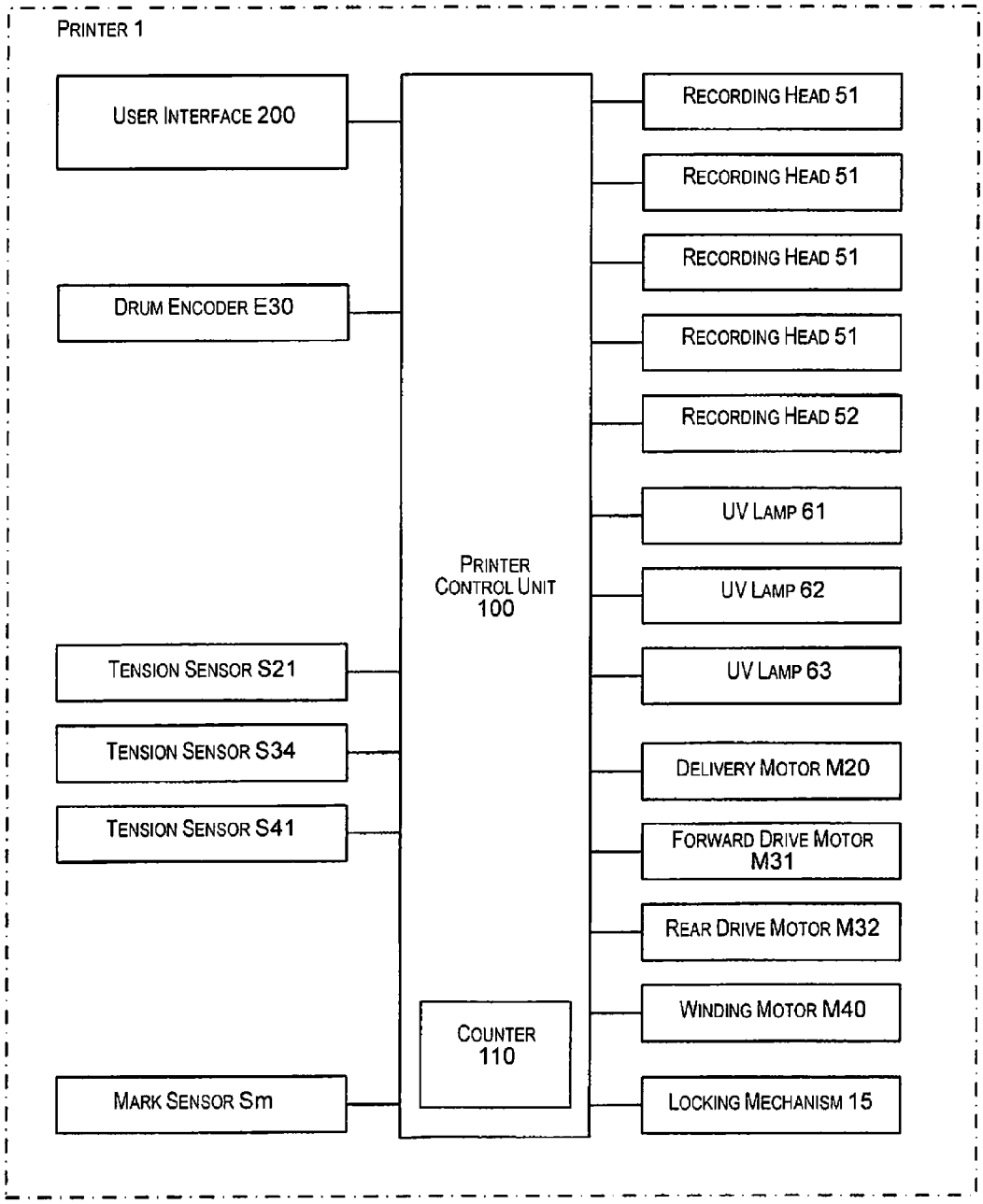
FIG. 3 is a block diagram schematically showing the electrical configuration for controlling the printer shown in FIG. 1.

The above is a summary of the device configuration of the printer 1. Following, we will describe the electrical configuration for controlling the printer 1. FIG. 3 is a block diagram schematically showing the electrical configuration for controlling the printer shown in FIG. 1. The printer 1 is equipped with a printer control unit 100 for controlling each part of the printer 1. In specific terms, the printer control unit 100 executes the following kind of control.

The printer control unit 100 receives input from the user and displays operation status of the printer 1 to the user via a user interface 200 that the printer 1 is equipped with. As the user interface 200, for example, it is possible to use a display having a touch panel function or the like, for example. When an instruction is input from the user, the user interface 200 transmits that instruction to the user interface 200. Then, the printer control unit 100 has an operation executed by each part of the printer 1 according to the received instruction.

Also, the printer control unit 100 manages controlling of locking and unlocking the doors 12, 13, and 14 of the exterior member 10. In specific terms, the printer control unit 100 locks or unlocks the doors 12, 13, and 14 by controlling a locking mechanism 15 consisting of an electromagnetic lock attached respectively to the doors 12, 13, and 14. In other words, by the user inputting an unlock instruction to the user interface 200, the user interface 200 transmits an unlock instruction to the printer control unit 100. Having received this, the printer control unit 100 sends an unlocking signal to the locking mechanism 15, and unlocks the doors 12, 13, and 14. Meanwhile, when the user inputs a locking instruction to the user interface 200, the user interface 200 transmits a locking instruction to the printer control unit 100. Having received this, the printer control unit 100 sends a locking signal to the locking mechanism 15, and locks the doors 12, 13, 14. The printer control unit 100 locks the doors 12, 13, and 14 when starting conveying of the web S regardless of an instruction from the user.

The printer control unit 100 controls the ink discharge timing of each recording head 51 for forming color images according to the conveyance of the web S. More specifically, this ink discharge timing control is executed based on the output (detection value) of a drum encoder E30 that is attached to the rotating shaft of the rotating drum 30 and detects the rotation position of the rotating drum 30. In other words, the rotating drum 30 performs following rotation following the conveyance of the web S, so if the output of the drum encoder E30 that detects the rotation position of the rotating drum 30 is referenced, it is possible to know the conveyance position of the web S. In light of that, the printer control unit 100 generates pts (print timing signal) signals from the output of the drum encoder E30, and by controlling the ink discharge timing of each recording head 51 based on the pts signal, the ink discharged by each recording head 51 is made to impact target positions on the conveyed web S, and a color image is formed.

Also, the timing for the recording head 52 to discharge the transparent ink is similarly controlled by the printer control unit 100 based on the output of the drum encoder E30. By doing this, it is possible to suitably discharge transparent ink on the color image formed by the plurality of recording heads 51. Furthermore, the light on and off timing and the irradiated light amount of the UV irradiators 61, 62, and 63 are also controlled by the printer control unit 100.

Also, the printer control unit 100 is in charge of the function of controlling the conveyance of the web S described in detail using FIG. 1. In other words, of the members constituting the web conveyance system, a motor is connected respectively to the delivery shaft 20, the forward drive roller 31, the rear drive roller 32, and the winding shaft 40. Also, the printer control unit 100 controls the speed and torque of each motor while rotating these motors, and controls the conveyance of web S. The details of this web S conveyance control are as noted hereafter.

The printer control unit 100 rotates a delivery motor M20 that drives the delivery shaft 20 and supplies the web S from the delivery shaft 20 to the forward drive roller 31. At this time, the printer control unit 100 controls the torque of the delivery motor M20, and adjusts the web S tension (delivery tension Ta) from the delivery shaft 20 to the forward drive roller 31. In other words, a tension sensor S21 that detects the size of the delivery tension Ta is attached to the driven roller 21 arranged between the delivery shaft 20 and the forward drive roller 31. This tension sensor S21 can be constituted by load cells that detect the size of the force received from the web S, for example. Also, the printer control unit 100 does feedback control of the torque of the delivery motor M20 based on the detection results (detection value) of the tension sensor S21 and adjusts the delivery tension Ta of the web S.

Also, the printer control unit 100 rotates the forward drive motor M31 that drives the forward drive roller 31 and the rear drive motor M32 that drives the rear drive roller 32. By doing this, the web S delivered from the delivery part 2 passes through the processing part 3. At this time, while speed control is executed on the forward drive motor M31, torque control is executed on the rear drive motor M32. In other words, the printer control unit 100 adjusts the rotation speed of the forward drive motor M31 to be constant based on the encoder output of the forward drive motor M31. By doing this, the web S is conveyed at a constant speed by the forward drive roller 31.

Meanwhile, the printer control unit 100 adjusts the tension of the web S (process tension Tb) from the forward drive roller 31 to the rear drive roller 32 by controlling the torque of the rear drive motor M32. In other words, a tension sensor S34 that detects the size of the process tension Tb is attached to the driven roller 34 arranged between the rotating drum 30 and the rear drive roller 32. This tension sensor S34 can for example be constituted using load cells that detect the size of the force received from the web S. Also, the printer control unit 100 adjusts the process tension Tb of the web S by doing feedback control of the torque of the rear drive motor M32 based on the detection results (detection value) of the tension sensor S34.

Also, the printer control unit 100 rotates the winding motor M40 that drives the winding shaft 40, and winds the web S conveyed by the rear drive roller 32 onto the winding shaft 40. At this time, the printer control unit 100 controls the torque of the winding motor M40 and adjusts the tension of the web S (winding tension Tc) from the rear drive roller 32 to the winding shaft 40. In other words, a tension sensor S41 that detects the size of the winding tension Tc is attached to the driven roller 41 arranged between the rear drive roller 32 and the winding shaft 40. This tension sensor S41 can be constituted, for example, by load cells that detect the size of the force received from the web S. Also, the printer control unit 100 performs feedback control of the torque of the winding motor M40 based on the detection results (detection value) of the tension sensor S41 and adjusts the winding tension Tc of the web S.

In this way, the printer control unit 100 records an image on the web S using recording heads 51 and 52 while conveying the web S in the conveyance direction Df toward the winding shaft 40 from the delivery shaft 20. At this time, the printer control unit 100 knows the conveyance amount of the web S based on the detection results of the mark sensor Sm. In other words, the printer control unit 100 has a counter 110, and each time the mark sensor Sm detects an alignment mark that passes through in the conveyance direction Df along with conveyance of the web S, the count value of the counter 110 is incremented. By doing this, it is possible to know the conveyance amount of the web S in the conveyance direction Df from the count value of the counter 110.

Also, the printer control unit 100 is capable of executing not only forward conveying for conveying the web S in the conveyance direction Df, but also reverse conveying for conveying the web S in a conveyance direction Db facing from the winding shaft 40 to the delivery shaft 20 (specifically, the reverse direction to the conveyance direction Df). In specific terms, by controlling each motor M20, M31, M32, and M40, the printer control unit 100 executes reverse conveying by rotating the delivery shaft 20, the forward drive roller 31, the rear drive roller 32, and the winding shaft 40 in the reverse direction to when doing forward conveying. At this time, the printer control unit 100 knows the conveyance amount of the web S with the reverse conveying based on the detection results of the mark sensor Sm. In other words, each time the mark sensor Sm detects an alignment mark that passes through in the conveyance direction Db according to conveyance of the web S, the count value of the counter 110 is decremented. By doing this, it is possible to know the conveyance amount of the web S in the conveyance direction Db from the count value of the counter 110.

This printer control unit 100 executes the image recording operation of recording an image on the web S while conveying the web S in the conveyance direction Df. Also, when stopping conveying of the web S along with ending of the image recording operation, the printer control unit 100 executes the conveyance stopping process of adjusting the position of the web S in relation to the nip roller 31*n* and then stopping the conveyance of the web S. Hereafter, we will give a detailed description of the conveyance stopping process executed by the printer control unit 100.

Figure 4:
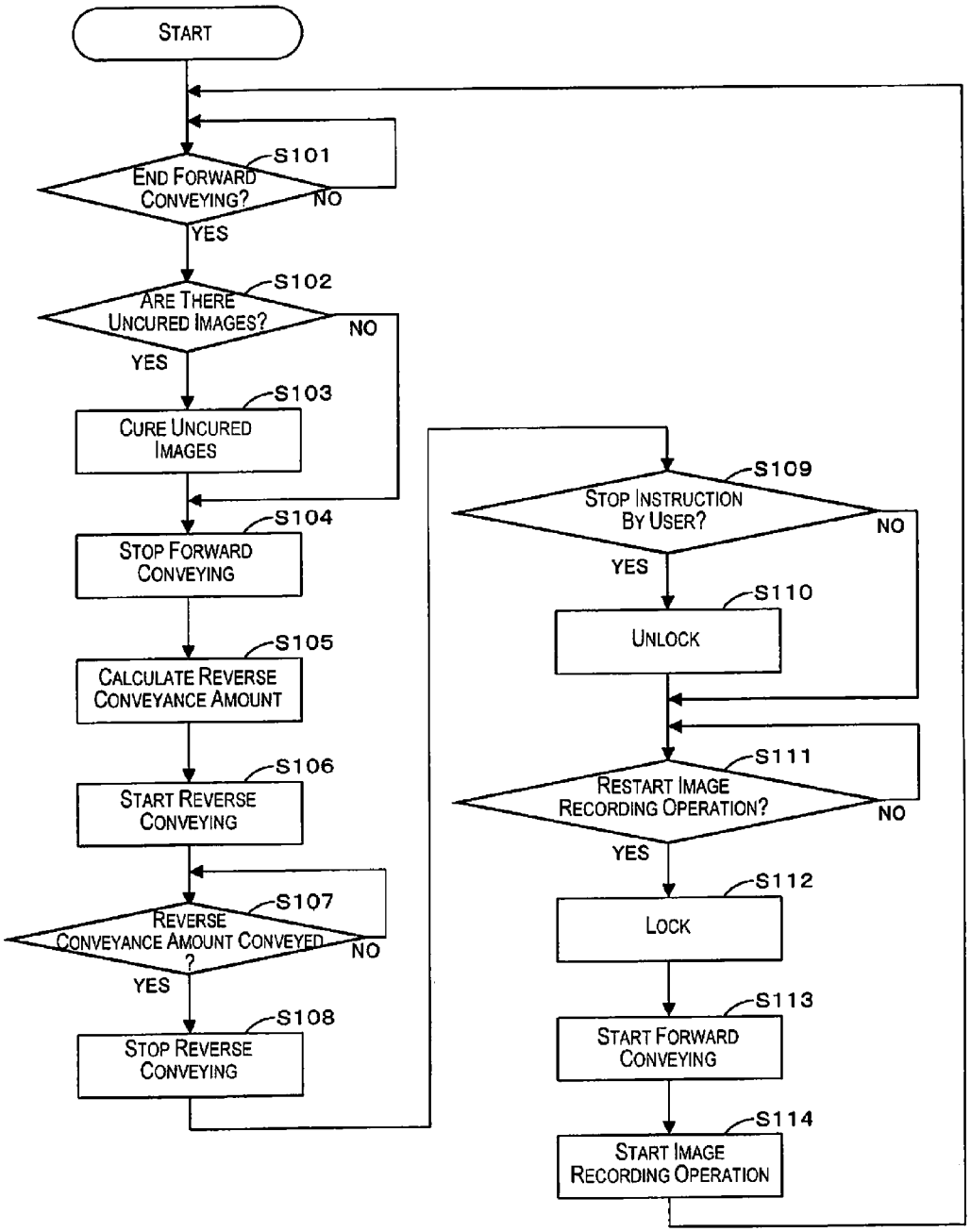
FIG. 4 is a flow chart showing an example of the forward conveying end control executed by the printer control unit.
Figure 5:
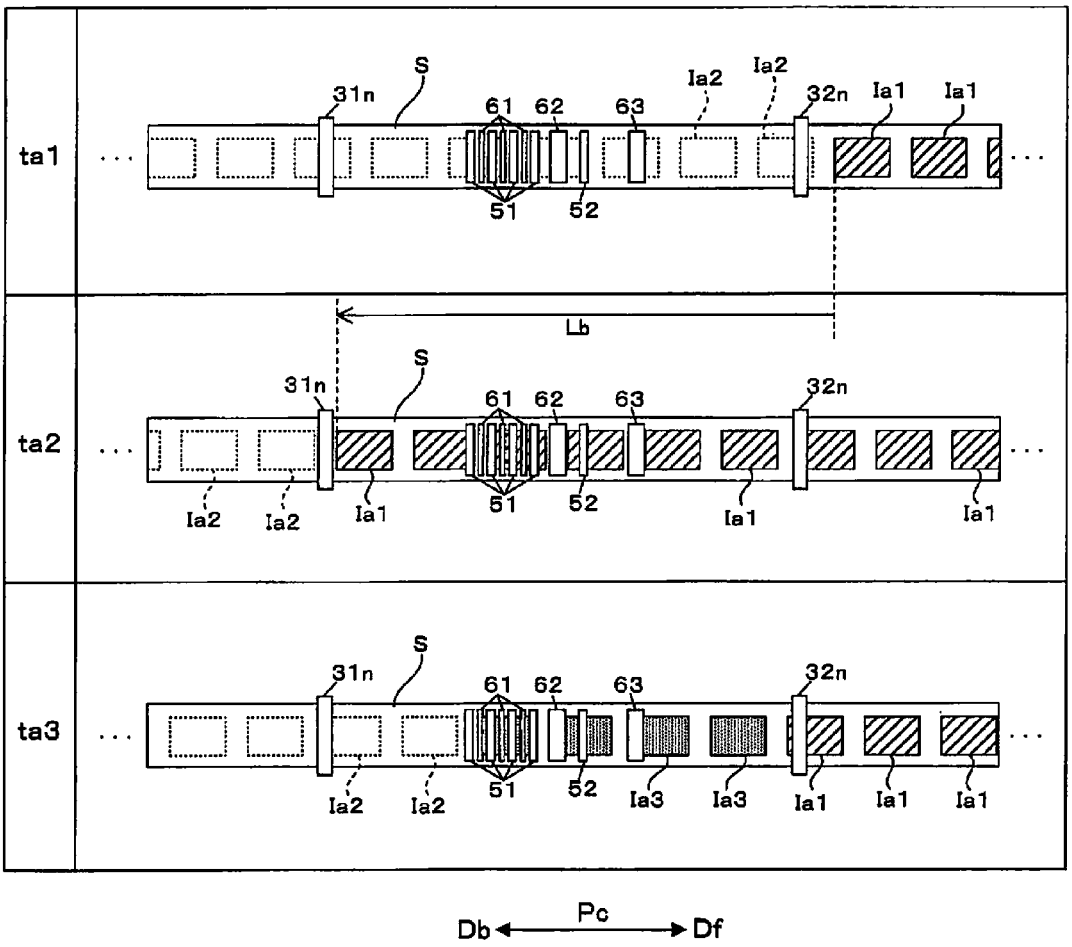
FIG. 5 is a drawing showing a first example of the operation executed according to the flow chart of FIG. 4.

FIG. 4 is a flow chart showing an example of the conveyance stopping process executed by the printer control unit 100. FIG. 5 is a drawing schematically showing the sequence of times ta1, ta2, and ta3 of a first example of the operation executed following the flow chart of FIG. 4, and shows the state of development along the conveyance path Pc. In both drawings, there is illustration regarding not only the conveyance stopping process, but also the image recording operation that is started again after that. In FIG. 5, the rectangle with diagonal cross hatching is image Ia1 recorded with the image recording operation before the conveyance stopping process, the rectangle enclosed by a dotted line is unrecorded image Ia2 for which an image is planned to be recorded after the conveyance stopping process, and the rectangle with dot hatching is image Ia3 recorded with the image recording operation restarted.

At step S101, a judgment is made of whether or not to end the forward conveying that is midway in execution. Then, when ending the forward conveying of the web S, it is determined to end forward conveying (step S101 "Yes"), and the process proceeds to step S102. In specific terms, for example when forward conveying stops along with completion of the image recording operation on the web 5, when forward conveying is forcibly stopped with suspension of the image recording operation according to a stop instruction input from the user or the like, a judgment is made to end forward conveying at step S101.

At step S102, a judgment is made of whether there is an uncured image on the web S. Then, when there is no uncured image (when "No" at step S102), the process proceeds to step S104 and forward conveying of the web S stops. On the other hand, when there is an uncured image (when "Yes" at step S102), forward conveying of the web S is continued until that uncured image passes under the main curing UV irradiator 63, and curing (main curing) of the uncured image is executed (step S103). Then, after curing of all the images is completed, the process proceeds to step S104, and forward conveying of the web S is stopped. As a result, with the example in FIG. 5, at time ta1, in a state with the all the images Ia1 for which recording was already done by the recording heads 51 and 52 moved to the downstream side of the conveyance direction Df of the UV irradiator 63, forward conveying of the web S is stopped.

Next, reverse conveying is executed so as to move unrecorded area Ia2 for which an image is planned to be recorded first with the image recording operation to restart thereafter, said another way, unrecorded area Ia2 the furthest downstream (at the head) in the conveyance direction Df, and said yet another way, unrecorded area Ia2 adjacent to image Ia1 the furthest upstream (at the tail) in the conveyance direction Df (in other words, to cue it). At this time, after execution of reverse conveying, the reverse conveyance amount Lb necessary to stop the web S in a state with the nip roller 31*n* not in contact with the unrecorded area Ia2 is calculated. Next, together with starting reverse conveying of the web S (step S106), a judgment is made of whether or not conveying is completed of the reverse conveyance amount Lb (step S107) based on the count value of the counter 110. Then, when conveying of the reverse conveyance amount Lb is completed ("Yes" at step S107), reverse conveying is stopped at step S108. As a result, as shown with the example in FIG. 5, in a state with nip roller 31*n* in contact with the white margin between the head unrecorded area Ia2 and the tail image Ia1, reverse conveying of the web S is stopped. In this way, the conveyance stopping process having each step from step S101 to S108 is completed (time ta2).

Next, at step S109, a judgment is made of whether or not the reason that it was determined to end forward conveying at step S101 was due to a stop instruction from the user. Then, when the reason was other than a stop instruction from a user (when "No" at step S109), with the locks left in place for doors 12, 13, and 14, the process advances to step S111. On the other hand, when a stop instruction from the user was the reason (when "Yes" at step S109), after the doors 12, 13, and 14 are unlocked (step S110), the process advances to step S111.

At step S111, a judgment is made of whether or not to restart the image recording operation. Then, when it is judged to restart the image recording operation ("Yes" at step S111), after locking the doors 12, 13, and 14 at step S112, forward conveying is started at step S113. Then, when the head unrecorded area Ia1 reaches the recording head 51, the image recording operation is restarted (step 114), and the process returns to step S101. With the image recording operation restarted in this way, as shown with the example in FIG. 5, the image Ia3 is recorded in sequence on each unrecorded area Ia2 (time ta3).

With this embodiment as described above, while conveying the web S grasped between the forward drive roller 31 and the nip roller 31*n* in the conveyance direction Df, an image is recorded on the web S by the recording heads 51 and 52 arranged further to the downstream side in the conveyance direction Df than the forward drive roller 31. With this constitution, when conveying of the web S stops for a long time, of the web S, there may be degeneration of the part that is stopped between the forward drive roller 31 and the nip roller 31*n*. Therefore, with the image recording operation after that, with the image Ia3 formed overlapping that degenerated part, there was the risk of a problem occurring of the degenerated part being visible as a streak mark (nip mark) (specifically, the problem of a decrease in image quality).

Various causes have been inferred for causing these nip marks. Specific examples include the possibility of an electrical charge due to contact for a long time of the surface of the webs on the nip roller 31*n*, leading to, degeneration. Alternatively, as will be described in detail next, it is also possible to have degeneration of the surface of the web S caused by a component expressed from the nip roller 31*n*.

For example, when using a rubber roller as the nip roller 31*n*, a rubber component is expressed to the outer circumference surface of the nip roller 31*n* due to a phenomenon of so-called bleeding. Therefore, when conveying of the web S is stopped for a fixed time or greater, a large amount of the component expressed from the rubber adheres to the part in contact with the nip roller 13*n* of the web S, and there is degeneration of the web S at that part. As a result, when performing image recording on the web S after that, the qualitative sense of the image of the degenerated part is different from the qualitative sense of the image at the other parts, and there were cases when the image recorded at the degenerated part was visible as streak marks (nip marks). Also, when using a PFA roller as the nip roller 31*n* as well, there were also cases when nip marks were visible which were possibly attributable to components expressed from the nip roller 31*n*.

Nip marks that occur due to that reason are thought to have a trend of appearing especially markedly on webs S having a film base material more than webs S having a paper base material. In other words, with the web S having a paper type base material, the component expressed from the outer circumference surface of the nip roller 31*n* is soaked into the base material and absorbed, so the wettability of the base material surface does not worsen that much, and the nip mark does not stand out. On the other hand, with the web S having a film type base material, the component expressed from the outer circumference surface of the nip roller 31*n* does not soak into the base material, so the wettability of the base material surface worsens, and the nip mark is marked.

With this embodiment in relation to this kind of nip mark problem, in a state for which, of the web S, an area (white margin area) different from the unrecorded area Ia2 for which the image Ia3 is planned to be recorded after the point when conveyance of the web S is stopped is in contact with the nip roller 31*n*, conveyance of the web S is stopped (steps S101 to S108). Therefore, even if of the web S, the part grasped between the forward drive roller 31 and the nip roller 31*n* is degenerated while the conveyance is stopped, there is no recording of the image Ia3 on the degenerated part with the image recording operation thereafter. As a result, it is possible to suppress the occurrence of the kind of nip marks noted above.

Also, with this embodiment, when the reason for stopping forward conveying was a stop instruction from the user, the doors 12, 13, and 14 were locked until reverse conveying stopped (specifically, until the conveyance stopping process was completed), and the doors 12, 13, and 14 were unlocked after reverse conveying stopped (specifically, after the conveyance stopping process was completed). With this constitution, it is possible to prevent the user from accessing the inside of the exterior member 10 by locking the doors 12, 13, 14 until the reverse conveying stops, and after the reverse conveying has stopped, it is possible for the user to execute the desired task by accessing the interior of the exterior member 10 using the doors 12, 13, and 14.

Figure 6:
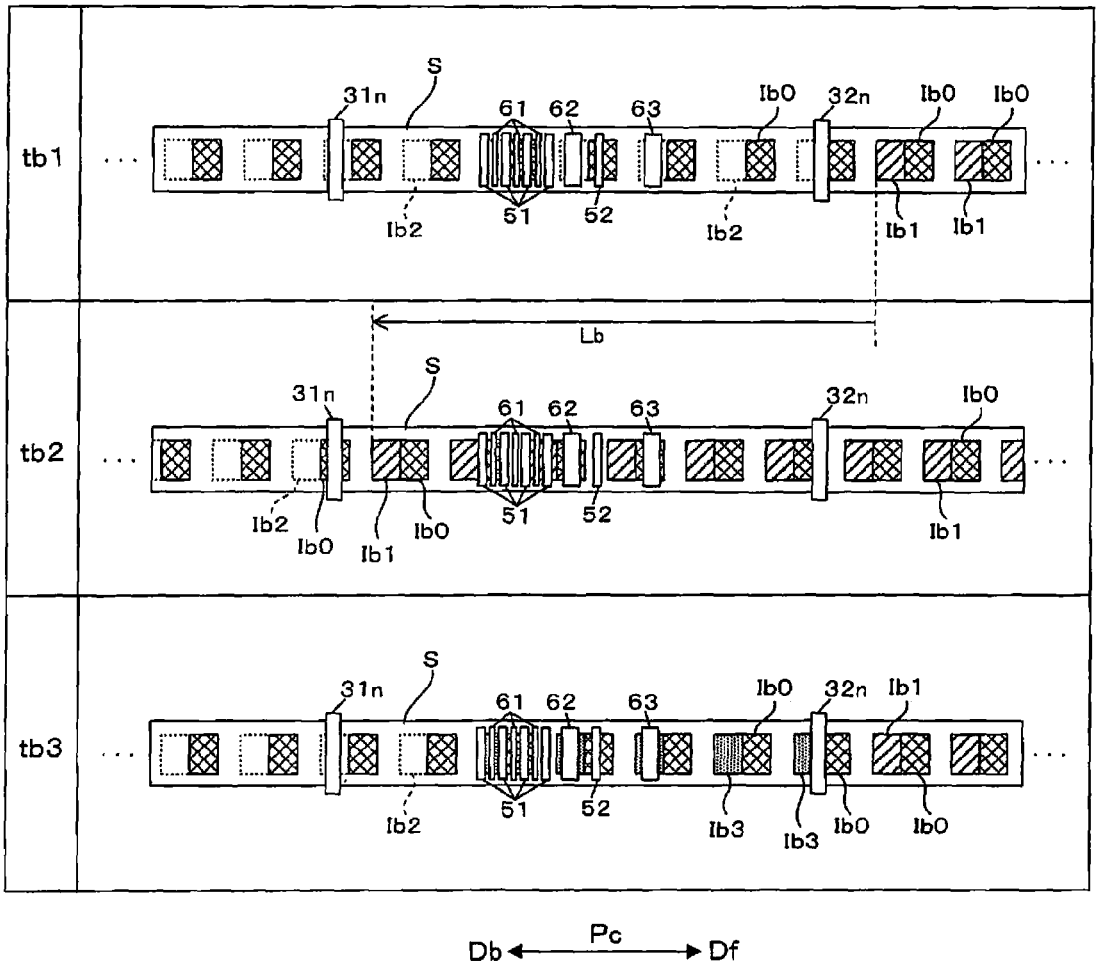
FIG. 6 is a drawing showing a second example of the operation executed according to the flow chart of FIG. 4.

FIG. 6 is a drawing schematically showing a second example of the operation executed following the flow chart of FIG. 4 in sequence of times tb1, tb2, tb3, and shows the situation developing along the conveyance path Pc. In FIG. 6, we will describe a case when so-called overprint printing with which an image is further recorded on the web S on which a printed image has already been printed using a different printer from the printer 1, for example. At this time, each image recorded by the printer 1 can be the same as each other, or can also be mutually different as with so-called variable printing. With FIG. 6, the rectangle with halftone crosshatching is already printed image Ib0 that has already been printed on the web S, the rectangle with the diagonal cross hatching is image Ib1 recorded by the image recording operation before the conveyance stopping process, the rectangle surrounded by dotted lines is unrecorded area Ib2 for which an image is planned to be recorded after the conveyance stopping process, and the rectangle with dot cross hatching is image Ib3 recorded with the image recording operation that was restarted.

As shown in FIG. 6, with the overprint printing shown with the second example, images Ib1 and Ib3 are recorded adjacent to already printed image Ib0. Hereafter, we will mainly describe the constitution that differs from the first example, and will omit a description of common constitutions as appropriate. It also goes without saying that the same effects as with the first example are exhibited by being equipped with constitutions in common with the first example.

With the second example as well, when stopping of forward conveying is judged at step S101, curing of the uncured image of step S103 is performed as appropriate according to the judgment results of step S102, and forward conveying is stopped at step S104. As a result, with the example in FIG. 6, at time tb1, in a state with all the images Ib1 already recorded by the recording heads 51 and 52 moved to the downstream side of the conveyance direction Df of the UV irradiator 63, forward conveying of the web S is stopped.

Next, reverse conveying is executed to move unrecorded image Ib2 for which recording of an image is first planned with the image recording operation restarted thereafter to the upstream side of the conveyance direction Df of each recording head 51 (specifically, to put it to the head). Specifically, the reverse conveyance amount Lb needed to stop the web S in a state for which the nip roller 31*n* does not contact the unrecorded area Ib2 after execution of the reverse conveying is calculated, and the web S is reverse conveyed by the reverse conveyance amount Lb (steps S106 to S108). As a result, as shown with the example in FIG. 6, in a state with the nip roller 31*n* contacting the already printed image Ib0 between the head unrecorded area Ib2 and the tail image Ib1, reverse conveying of the web S is stopped. In this way, the conveyance stopping process of each of steps S101 to S108 is completed (time tb2).

Then, when a judgment is made to restart the image recording operation at step S111, forward conveying of the web S starts at S113, and the image recording operation restarts at step S114. With the image recording operation restarted in this way, as shown with the example in FIG. 6, the image Ib3 is recorded in sequence on each unrecorded area Ib2 (time tb3).

In this way, with this embodiment, in a state for which, of the web S, an area different from unrecorded area Ib2 on which image Ib3 is planned to be recorded after the point when conveying of the web S stops, in particular with the second example, the area at which already printed image Ib0 is positioned is in contact with the nip roller 31*n*, conveying of the web S is stopped (steps S101 to S108). Therefore, even if of the web S, the part grasped between the forward drive roller 31 and the nip roller 31*n* is degenerated while conveyance is stopped, there is no recording of the image Ib3 on that degenerated part with the image recording operation after that. As a result, it is possible to suppress the occurrence of nip marks like those noted above.

However, with the first example and second example noted above, by having the web S stop in a state with a different area from the unrecorded areas Ia2 and Ib2 in contact with the nip roller 31*n*, the occurrence of nip marks was suppressed. However, even if the web S is stopped without taking special consideration of the positional relationship of the unrecorded areas Ia2 and Ib2 and the nip roller 31*n*, with the third example that follows, it is possible to suppress the occurrence of nip marks.

Figures 7, 8:
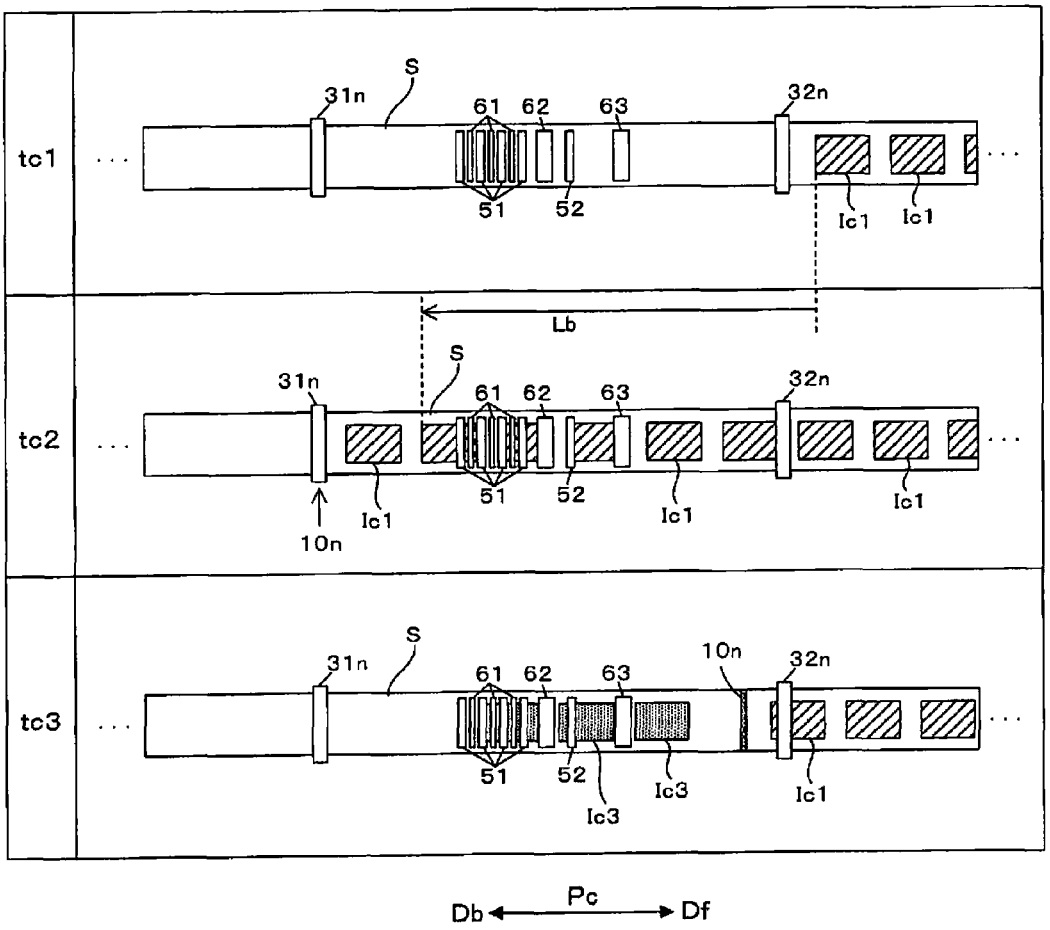
FIG. 7 is a drawing showing a third example of the operation executed according to the flow chart of FIG. 4.
FIG. 8 is a drawing showing the results of testing the relationship between the nip load, nip time, and nip marks.

FIG. 7 is a drawing that schematically shows the third example of the operation executed following the flow chart of FIG. 4 in sequence of times tc1, tc2, and tc3, and shows the situation developing along the conveyance path Pc. In FIG. 6, the rectangle with the diagonal cross hatching is the image Ic1 recorded with the image recording operation before the conveyance stopping process, and the rectangle with the dot hatching is the image Ic3 recorded with the restarted image recording operation. Hereafter, we will describe mainly the different constitutions from the first example, and will omit a description of the common constitutions as appropriate. It goes without saying that the same effects as those of the first example are exhibited by being equipped with common constitutions.

With the third example as well, when a judgment is made to stop forward conveying at step S101, curing of the uncured image is performed as appropriate at step S103 according to the judgment results at step S102, and forward conveying is stopped at step S104. As a result, with the example in FIG. 7, at time tc1, in a state with all the images Ic1 already recorded by the recording heads 51 and 52 moved to the downstream side of the conveyance direction Df of the UV irradiator 63, forward conveying of the web S is stopped.

Next, the printer control unit 100 executes reverse conveying. However, this reverse conveying is not performed while considering the positional relationship of the unrecorded areas Ia2 and Ib2 and the nip roller 31*n* as was the case with the first example and the second example. Specifically, the printer control unit 100 calculates the reverse conveyance amount Lb necessary for being put to the head without considering in particular the positional relationship of the unrecorded areas Ia2 and Ib2 and the nip roller 31*n*, and does reverse conveying of the web S by the reverse conveyance amount Lb (steps S106 to S108). Thus, the conveyance stopping process having each of steps S101 to S108 is completed (time tc2).

Then, when a judgment is made to restart the image recording operation at step S111, forward conveying of the web S is started at step S113, and the image recording operation is restarted at step S114. In particular with the third example, of the web S, so as to have the contact part 10*n* that was in contact with the nip roller 31*n* during stopping of conveyance of the web S removed to have the image Ic3 recorded, the position at which the image Ic3 is recorded is adjusted with the image recording operation after restarting (time tc3).

In this way, with the third example, the printer control unit 100 executes the image recording operation for recording the image on the web S while conveying the web S in the conveyance direction Df. In fact, with the image recording operation executed after stopping conveying of the web S, the printer control unit 100 records the image Ic3 on, of the web S, the area different from the area that was in contact with the nip roller 31*n* during stopping of conveying of the web S. Therefore, even if the contact part 10*n* that was grasped between the forward drive roller 31 and the nip roller 31*n* of the web S is degenerated during conveyance stopping, there is no recording of the image Ic3 on that degenerated part 10*n* during the image recording operation after that. As a result, it is possible to suppress the occurrence of nip marks like those noted above.

As described above, with this embodiment, the printer 1 correlates to an example of the "image recording device" of the present invention, the forward drive roller 31 correlates to an example of the "drive roller" of the present invention, the nip roller 31*n* correlates to an example of the "driven roller" of the present invention, the printer control unit 100 correlates to an example of the "control unit" of the present invention, the web S correlates to an example of the "recording media" of the present invention, the conveyance direction Df correlates to an example of the "first direction" of the present invention, and the conveyance direction Db correlates to an example of the "second direction" of the present invention, and the already printed image Ib0 correlates to an example of the "printed image" of the present invention. Also, the exterior member 10 correlates to an example of the "exterior member" of the present invention, doors 12, 13, and 14 respectively correlate to an example of the "doors" of the present invention, the locking mechanism 15 correlates to an example of the "locking mechanism" of the present invention, and the user interface 200 correlates to an example of the "user interface" of the present invention.

The present invention is not limited to the embodiments noted above, and it is possible to add various modifications to the items described above as long as it does not stray from the gist. For example, when grasping the web S between the forward drive roller 31 and the nip roller 31*n* as noted with the embodiments above, a nip load is applied to the web S. There is no specific numerical value mentioned for this nip load, but for example if the nip load is set from 86 N to 128 N, it is possible to relatively stably perform conveying of various webs S. At this time, as the nip roller 31*n*, for example it is possible to use the PFA roller described above.

Also, with the embodiments noted above, nothing was mentioned in particular regarding the time required for switching the conveyance direction from forward conveying to reverse conveying with the conveyance stopping process, specifically, the time from when the forward conveying stops until reverse conveying starts. However, for that time, a part of the web S during temporary stopping for that switching is in a state grasped between the forward drive roller 31 and the nip roller 31*n*. In light of that, it is preferable to suitably set the time of temporary stopping of the web S between the forward drive roller 31 and the nip roller 31*n*, specifically, the nip time. FIG. 8 shows an example of the setting situation of that nip time.

FIG. 8 is a drawing showing in table form the results of testing the relationship between nip load, nip time, and nip marks. In this drawing, shown are the results of confirming by eye the nip marks with forming of an image of cyan single color with printing duty of 50% after grasping of the web S of #76911 made by Avery Dennison Corp. between the forward drive roller 31 and the nip roller 31*n* for each nip time at each nip load. From these test results, with the nip load of 86 N to 128 N described above, specifically when a nip load of about 100 N is given to the web S, we can see that it is preferable to have the nip time be 10 seconds or less, and more preferably to be 2.5 seconds or less. In particular, when the nip time is set to 2.5 seconds or less, the nip mark cannot be confirmed with the naked eye. In other words, if reverse conveying starts within 2.5 seconds after forward conveying starts, the unrecorded web S stopping time between the forward drive roller 31 and the nip roller 31*n* can be suppressed to within 2.5 seconds or less, and it is possible to more reliably inhibit the occurrence of nip marks.

Also, with the embodiments noted above, as reasons for stopping of the forward conveying, examples were shown of when the image recording operation is completed, and when there is a stop instruction by the user. However, it is possible to use the present invention even in a case when stopping the forward conveying due to reasons other than these.

In light of that, it is also possible to use the present invention when forward conveying ends when performing maintenance such as cleaning and wiping, for example. In specific terms, reverse conveying is performed by the reverse conveyance amount Lb noted above after forward conveying ends. Then, it is also possible to execute maintenance in parallel with reverse conveying or after reverse conveying stops. Here, cleaning is an operation of forcibly exhausting ink from the nozzles of the recording heads 51 and 52, and wiping is an operation of wiping the surface on which nozzles are formed of the recording heads 51 and 52 using a wiper. These maintenances are executed in a state with the recording heads 51 and 52 moved to a maintenance position (not illustrated) provided adjacent to the rotating drum 30 in the direction perpendicular to the paper surface in FIG. 1.

Alternatively, it is also possible to use the present invention when the forward conveying ends when confirming the ink discharge state from the nozzles of the recording heads 51 and 52. In specific terms, reverse conveying is performed by the reverse conveyance amount Lb noted above after the forward conveying ends. It is also possible to execute confirmation of the ink discharge state in parallel with the reverse conveying or after reverse conveying stops. Confirmation of the ink discharge state can be performed using a method based on residual vibration of a vibrating plate that applies pressure within the nozzles of the recording heads 51 and 52 such as with Patent Publication No. 3794431, for example. At this time, confirmation of the ink discharge state can be executed with the recording heads 51 and 52 as is facing opposite the rotating drum 30 when there is no discharge of ink from the nozzles, or can be executed after moving the recording heads 51 and 52 to the maintenance position described above when there is discharge of ink from the nozzles.

Also, with the embodiments noted above, reverse conveying was executed with the conveyance stopping process. However, even if reverse conveying is not executed with the conveyance stopping process, it is possible to suppress the occurrence of nip marks by doing as follows. In other words, the printer control unit 100 continues conveying the web S in the conveyance direction Df as is for a time when a judgment is made to stop conveyance of the web S in the conveyance direction Df. Then, in accordance with the conveyance of the web S in the conveyance direction Df, control of conveying of the web S is done such that at the timing when an area different from the unrecorded areas Ia2 and Ib2 (specifically, white margin areas or areas for which already printing images are provided) reach the nip rollers 31*n* and 32*n*, conveying of the web S in the conveyance direction Df stops. With this constitution as well, conveying of the web S stops in a state with the areas different from the unrecorded areas Ia2 and Ib2 in contact with the nip rollers 31*n* and 32*n*. Therefore, even if, of the web S, the part grasped between the forward drive roller 31 and the nip roller 31*n* and between the forward drive roller 32 and the nip roller 32*n* is degenerated during conveyance stopping, there is no recording of an image on that degenerated part with the image recording operation after that. As a result, it is possible to suppress the occurrence of nip marks like those noted above. Incidentally, in this case, the reverse conveying for moving to the head can be implemented after instructions to restart for the image recording operation.

Also, the specific location of the web S to contact the nip roller 31*n* in a stopped state is not limited to the examples noted above. In other words, it is sufficient as long as the web S is stopped in a state for which, of the web S, an area different from the area for which recording of an image is planned after the point that conveyance of the web S stops is put in contact with the nip roller 31*n*. Examples include the image Ia1, image Ib1, between image Ia1 and image Ia1, between the image Ib0 and image Ib0, between the image Ib0 and image Ib1, between the unrecorded area Ia2 and unrecorded area Ia2, and between the unrecorded area Ib2 and image Ib0.

Also, with the embodiments noted above, the forward drive roller 31 contacted the back surface of the web S, and the nip roller 31*n* contacted the front surface of the web S. However, it is also possible to arrange the rollers 31 and 31*n* such that the forward drive roller 31 contacts the front surface of the web S, and the nip roller 31*n* contacts the back surface of the web S.

Also, with the embodiments noted above, an image was recorded by discharging UV ink from the recording heads 51 and 52. However, it is also possible to record an image by discharging water based ink from the recording heads 51 and 52.

Also, for the member that supports the conveyed web S as well, this is not limited to being a cylindrical shaped item such as the rotating drum 30 noted above. Therefore, it is also possible to use a flat type platen that supports the web S on a flat surface.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image recording device comprising:

a drive roller configured and arranged to convey recording medium by rotating;

a driven roller configured and arranged with respect to the drive roller so that the recording medium is grasped between the drive roller and the driven roller;

a recording unit configured and arranged to record an image on the recording medium arranged further to a downstream side than the drive roller in a first direction which is the recording medium conveyance direction;

a sensor configured to detect alignment marks on the recording medium; and a control unit configured to control the recording unit and the drive roller to record the image on the recording medium while conveying the recording medium in the first direction, the control unit being further configured to control conveying of the recording medium based on detection results of the sensor, wherein when the control unit stops the conveying of the recording medium in the first direction, the control unit is configured to calculate, based on the detection results, a conveyance amount of the recording medium for stopping the conveying of the recording medium with a non-printed area being in contact with the driven roller, and by controlling the conveying of the recording medium based on the conveyance amount, stop the conveying of the recording medium in a state in which the non-printed area of the recording medium is in contact with the driven roller, the non-printed area being an area in which the image is not to be recorded after a timing at which the conveying of the recording medium is stopped and is different from an area, in which the image is planned to be recorded after the timing at which the conveying of the recording medium is stopped.

2. The image recording device according to claim 1, wherein when the control unit stops the conveying of the recording medium in the first direction, the control unit is configured to stop the conveying of the recording medium in a state in which, the non-printed area of the recording medium between an area, in which the recording unit has already recorded the image, and the area, in which the image is planned to be recorded after the timing at which the conveying of the recording medium is stopped, is in contact with the driven roller.

3. The image recording device according to claim 1, wherein the recording unit is configured and arranged to record the image on the recording medium having an already printed print image, and when the control unit stops the conveying of the recording medium in the first direction, the control unit is configured to stop the conveying of the recording medium in a state in which, the non-printed area of the recording medium, which is an area in which the print image is printed before the timing at which the conveying of the recording medium is stopped and which is different from the area in which an image is planned to be recorded after the timing at which the conveying of the recording medium is stopped, is in contact with the driven roller.

4. The image recording device according to claim 1, wherein the control unit is configured to stop the conveying of the recording medium in the first direction when the non-printed area of the recording medium different from the area, in which the image is planned to be recorded from after the timing at which conveying of the recording is stopped, reaches the driven roller as the recording medium is conveyed in the first direction.

5. The image recording device according to claim 1, wherein the driven roller has rubber on an outer circumference surface, and a surface of the recording medium on which the image is recorded is contacted by the outer circumference surface.

6. The image recording device according to claim 1, wherein the driven roller has a tetrafluoro ethylene perfluoro alkyl vinyl ether copolymer on an outer circumference surface, and a surface of the recording medium on which the image is recorded is contacted by the outer circumference surface.

7. An image recording device comprising:

a drive roller configured and arranged to convey recording medium by rotating;

a driven roller configured and arranged with respect to the drive roller so that the recording medium is grasped between the drive roller and the driven roller;

a recording unit configured and arranged to record an image on the recording medium arranged further to a downstream side than the drive roller in a first direction which is the recording medium conveyance direction; and a control unit configured to control the recording unit and the drive roller to record the image on the recording medium while conveying the recording medium in the first direction, when the control unit stops conveying of the recording medium in the first direction, the control unit being configured to stop conveying of the recording medium in a state in which an area of the recording medium different from an area, in which the image is planned to be recorded after a timing at which conveying of the recording medium is stopped, is in contact with the driven roller, when the control unit stops conveying of the recording medium in the first direction, the control unit being configured to convey a prescribed amount of the recording medium in a second direction reverse to the first direction after stopping conveying of the recording medium in the first direction and to stop conveying of the recording medium in a state in which an area of the recording medium different from the area, in which the image is planned to be recorded after the timing at which conveying of the recording medium is stopped, is in contact with the driven roller.

8. The image recording device according to claim 7, wherein the control unit is configured to control the drive roller to start conveying the recording medium in the second direction within 2.5 seconds after conveying of the recording medium in the first direction stops.

9. The image recording device according to claim 7, further comprising:

an exterior member housing the drive roller, the driven roller, and the recording unit;

a door provided on the exterior member;

a locking mechanism configured and arranged to lock the door; and a user interface configured and arranged to receive instructions from a user and to transmit the instructions to the control unit, wherein the control unit is configured to control the drive roller to stop conveying of the recording medium in the first direction in accordance with a stop instruction from the user, to control the locking mechanism to lock the door until conveying of the recording medium in the second direction stops, and to unlock the door after conveying of the recording medium in the second direction has stopped.

10. An image recording method comprising:

recording an image on a recording medium by a recording unit arranged further to a downstream side in a first direction, which is a conveyance direction of the recording medium, than a drive roller while rotating the drive roller to convey the recording medium grasped between the drive roller and a driven roller;

detecting alignment marks on the recording medium by a sensor;

calculating, based on detection results of the sensor, a conveyance amount of the recording medium for stopping conveying of the recording medium with a non-printed area being in contact with the driven roller, the non-printed area being an area in which the image is not to be recorded after a timing at which conveying of the recording medium is stopped and is different from an area, in which the image is planned to be recorded after the timing at which conveying of the recording medium is stopped; and by controlling the conveying of the recording medium based on the conveyance amount, stopping the conveying of the recording medium in a state in which the non-printed area of the recording medium is in contact with the driven roller.

* * * * *